US012320356B2

(12) United States Patent
Jeon et al.

(10) Patent No.: US 12,320,356 B2
(45) Date of Patent: Jun. 3, 2025

(54) SCROLL COMPRESSOR

(71) Applicant: Hanon Systems, Daejeon (KR)

(72) Inventors: Jong Hyun Jeon, Daejeon (KR); Kwang Jin Kim, Daejeon (KR); Kyung Jae Lee, Daejeon (KR); Soo Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/292,803

(22) PCT Filed: Apr. 13, 2023

(86) PCT No.: PCT/KR2023/004993
§ 371 (c)(1),
(2) Date: Jan. 26, 2024

(87) PCT Pub. No.: WO2024/071547
PCT Pub. Date: Apr. 4, 2024

(65) Prior Publication Data

US 2025/0003408 A1 Jan. 2, 2025

(30) Foreign Application Priority Data

Sep. 28, 2022 (KR) ..... 10-2022-0123776
Feb. 22, 2023 (KR) ..... 10-2023-0023468

(51) Int. Cl.
*F04C 27/00* (2006.01)
*F04C 18/02* (2006.01)
*F04C 29/12* (2006.01)

(52) U.S. Cl.
CPC ..... *F04C 27/008* (2013.01); *F04C 18/0215* (2013.01); *F04C 29/12* (2013.01); *F04C 29/124* (2013.01); *F04C 2240/30* (2013.01)

(58) Field of Classification Search
CPC .. F04C 18/02; F04C 18/0246; F04C 18/0253; F04C 29/12; F04C 29/124; F04C 27/008
See application file for complete search history.

(56) References Cited

U.S. PATENT DOCUMENTS 11,953,010 B2 * 4/2024 Lee ..... F04C 29/042
12,055,142 B2 * 8/2024 Lee ..... F04C 29/128

FOREIGN PATENT DOCUMENTS

| | | | |
|---|---|---|---|
| JP | H11141474 | A | 5/1999 |
| JP | 2015129475 | A | 7/2015 |
| KR | 20150083036 | A | 7/2015 |
| KR | 20180094483 | A | 8/2018 |
| KR | 20190134054 | A | 12/2019 |
| KR | 20210118743 | A | 10/2021 |

* cited by examiner

*Primary Examiner* — Deming Wan
(74) *Attorney, Agent, or Firm* — Shumaker, Loop & Kendrick, LLP; James D. Miller

(57) ABSTRACT

A scroll compressor capable of improving the performance and efficiency of the compressor by increasing the amount of refrigerant discharged from a compression chamber by introducing not only refrigerant at suction pressure but also refrigerant at an intermediate pressure to the compression chamber of the scroll compressor, capable of freely changing the position of a port by simplifying the shape of an injection valve assembly and by disposing a fastening member on an introduction chamber side, and capable of compactifying the injection valve assembly.

19 Claims, 8 Drawing Sheets

SCROLL COMPRESSOR

CROSS REFERENCE TO RELATED PATENT APPLICATIONS

This is a U.S. national phase patent application of PCT/KR2023/004993 filed Apr. 13, 2023 which claims the benefit of and priority to Korean Patent Application No. 10-2023-0023468 filed on Feb. 22, 2023 and Korean Patent Application No. 10-2022-0123776 filed on Sep. 28, 2022, the entire contents of each of which are incorporated herein by reference.

TECHNICAL FIELD

The present disclosure relates to a scroll compressor and more particularly to a scroll compressor capable of improving the performance and efficiency of the compressor by increasing the amount of refrigerant discharged from a compression chamber by introducing not only refrigerant at suction pressure but also refrigerant at an intermediate pressure to the compression chamber of the scroll compressor, capable of freely changing the position of a port by simplifying the shape of an injection valve assembly and by disposing a fastening member on an introduction chamber side, and capable of compactifying the injection valve assembly.

BACKGROUND ART

In general, a vehicle is equipped with an air conditioning (A/C) system for heating and cooling the interior of the vehicle. Such an air conditioning system includes a compressor as a component of the cooling system. The compressor compresses a low-temperature and low-pressure gaseous refrigerant introduced from an evaporator into a high-temperature and high-pressure gaseous refrigerant, and transfers it to a condenser.

There are two types of compressors, that is to say, a reciprocating type compressor which compresses a refrigerant according to a reciprocating motion of a piston and a rotary type compressor which compresses a refrigerant while performing a rotational motion. The reciprocating type compressor includes a crank type compressor which transmits a driving force of a driving source to a plurality of pistons by using a crank and a swash plate type compressor which transmits a driving force of a driving source to a rotating shaft with the swash plate installed therein, etc., in accordance with a transmission method of the driving source. The rotary type compressor includes a vane rotary type using a rotating shaft and a vane, and a scroll type compressor using an orbiting scroll and a fixed scroll.

The scroll compressor is widely used for refrigerant compression in air conditioners, etc., because the scroll compressor can obtain a relatively high compression ratio compared to other types of compressors and can obtain a stable torque thanks to smooth connection of the suction, compression, and discharge strokes of the refrigerant.

Patent Document 1 (KR 10-2018-0094483 A) discloses a scroll compressor in the related art that performs a series of processes of sucking only a refrigerant with suction pressure into a compression chamber, compressing the refrigerant, and then discharging the refrigerant to the outside. However, the scroll compressor in the related art has a problem in which a discharge amount of the refrigerant to be discharged from the compression chamber is determined, which causes a limitation in improving the performance and efficiency of the compressor.

To solve the problem, Patent Document 2 (KR 2021-0118743 A) discloses a scroll compressor equipped with an injection valve assembly 700 including a leakage prevention means and an injection valve configured to open or close an injection flow path that guides a middle-pressure refrigerant, which is introduced from the outside of a compressor, to a compression chamber C.

Specifically, the injection valve assembly 700 includes a cover plate 710, an injection valve 720, a valve plate 730, and a gasket retainer 790 provided as a leakage prevention means. A fastening bolt 770 is fastened to a fastening recess 138*a* of a rear housing through a first fastening hole 739*a* of the valve plate, a third fastening hole 796 of the gasket retainer, and a second fastening hole 714 of the cover plate, so that the injection valve assembly 700 can be fastened to the rear housing 130. Due to this, the gasket retainer 790 is compressed between the cover plate 710 and the valve plate 730 and sealing is made between them. The injection valve 720 is compressed together between the cover plate 710 and the gasket retainer 790 and fixed.

However, since the injection valve assembly 700 has a complex shape and is difficult to rotate, there is a problem that it is difficult to change the design according to positions of an introduction port 133 and a discharge port 131 for each vehicle. In other words, the injection valve assembly 700 has a low design flexibility. Also, there is a disadvantage that the fastening bolt 770 is disposed on the outside of a third annular wall 138 that forms an introduction chamber I, making a package larger.

SUMMARY

The purpose of the present disclosure is to provide a scroll compressor capable of improving the performance and efficiency of the compressor by increasing the amount of refrigerant discharged from a compression chamber by introducing not only refrigerant at suction pressure but also refrigerant at an intermediate pressure to the compression chamber of the scroll compressor, capable of freely changing the position of a port by simplifying the shape of an injection valve assembly and by disposing a fastening member on an introduction chamber side, and capable of compactifying the injection valve assembly.

The technical problem to be overcome in the present disclosure is not limited to the above-mentioned technical problems. Other technical problems not mentioned can be clearly understood from those described below by a person having ordinary skill in the art.

One embodiment is a scroll compressor including: a housing; a motor provided within the housing; a rotation shaft configured to be rotated by the motor; an orbiting scroll configured to perform an orbiting motion in conjunction with the rotation shaft; and a fixed scroll configured to form, together with the orbiting scroll, a compression chamber. The housing includes a rear housing that forms a discharge chamber receiving refrigerant discharged from the compression chamber. The rear housing includes a partition wall that partitions the discharge chamber and an introduction chamber into which the refrigerant is introduced from the outside of the housing. An injection valve assembly is provided between the fixed scroll and the partition wall of the rear housing, covers the introduction chamber, and guides the refrigerant of the introduction chamber to the compression chamber. The partition wall has a first surface and a second surface higher than the first surface such that they surround a portion of a side of the injection valve assembly. A fastening member which fastens the injection valve assembly to a rear housing is disposed radially inner side of the second surface.

The injection valve assembly may include a sealing portion for sealing between the injection valve assembly and a head of the fastening member.

The injection valve assembly may include: a cover plate configured to be disposed on the partition wall and has an inlet through which the refrigerant of the introduction chamber is introduced; a gasket retainer configured to be coupled to the partition wall; an injection valve configured to be interposed between the cover plate and the gasket retainer and opens or closes the inlet; and a valve plate configured to be coupled to the gasket retainer and to have an outlet through which the refrigerant introduced through the inlet flows out.

A sealing portion for sealing between the injection valve assembly and a head of the fastening member may be provided on one surface of the valve plate where the head of the fastening member is seated. The sealing portion may protrude to surround a fastening hole of the valve plate, through which the fastening member passes.

A sealing portion for sealing between the injection valve assembly and a head of the fastening member may be inserted between the head of the fastening member and one surface of the valve plate and may be compressed when the fastening member is tightened.

The gasket retainer may include: a bead portion extending along a circumference thereof and protruding toward the valve plate; and a fastening hole through which the fastening member passes. The bead portion may surround the fastening hole.

The bead portion may include an outer inclined bead portion on a radially outer side thereof, an inner inclined bead portion on a radially inner side thereof, and a protruding bead portion connecting the outer inclined bead portion and the inner inclined bead portion. The fastening hole may be formed more inward in the radial direction than the outer inclined bead portion.

The outer inclined bead portion may be compressed between the second surface and the valve plate when the injection valve assembly is assembled, and the inner inclined bead portion may be compressed between the first surface and the valve plate when the injection valve assembly is assembled.

The gasket retainer may include: a fastening hole through which the fastening member passes; a first bead portion which extends along a radial outer circumference of the fastening hole and protrudes toward the cover plate; and a second bead portion which extends along a radial inner circumference of the fastening hole and protrudes toward the cover plate.

The gasket retainer may further include: a retainer portion which is processed to be inclined in a direction in which the injection valve opens; and a valve bead portion which protrudes toward the valve plate.

The valve bead portion may be provided at a point where an inclination of the retainer portion starts.

A protrusion height of the first bead portion may be greater than a protrusion height of the second bead portion and a protrusion height of the valve bead portion.

The valve bead portion may be provided in a direction crossing a width of the retainer portion.

The injection valve may include a valve portion which is bent to open and close the inlet. A hole extending in a longitudinal direction of the valve portion may be provided in the valve portion.

The hole may be provided in a middle of the valve portion in a width direction of the valve portion and may extend in the longitudinal direction from a point where bending of the valve portion starts.

The gasket retainer may include: a circular body portion; a retainer portion which obliquely extends close to the valve plate toward the inlet from one side of the body portion; and a support portion which connects the retainer portion and the other side of the body portion in order to support the retainer portion and is formed to be inclined.

The support portion may be connected to an end of the retainer portion that is spaced furthest from the body portion in a direction in which the injection valve is opened, and a flow hole may be formed in the support portion.

An open surface of the flow hole may extend from the support portion to a portion of the body portion, and may include a surface parallel to the body portion and an inclined surface of the support portion.

The valve plate may include an inclined space where the retainer portion is seated. The outlet may communicate with the inclined space and may be disposed at a position corresponding to the flow hole.

The fastening hole of the valve plate, through which the fastening member passes, may be disposed on a radially outer side of the inclined space.

According to the embodiment of the present disclosure, it is possible to improve the performance and efficiency of the compressor by increasing the amount of the refrigerant discharged from the compression chamber by introducing not only refrigerant at suction pressure but also refrigerant at an intermediate pressure to the compression chamber of the scroll compressor.

Also, according to the embodiment, when the injection valve assembly is formed in a circular shape, the injection valve assembly is able to rotate with respect to the introduction chamber, so that it is possible to freely change the design of the injection valve assembly depending on the position of the port for each vehicle. Also, an axial force of the fastening member and surface pressure generated by the bead portion of the gasket retainer may be wholly uniformly transferred along the perimeter of the injection valve assembly.

Also, according to the embodiment, when the fastening member is disposed on the introduction chamber side, that is, on the first surface of the partition wall forming the introduction chamber, the injection valve assembly can be compactified. When the sealing portion is provided on one side of the valve plate where the head of the fastening member is seated, refrigerant leakage can be prevented.

Also, according to the embodiment, when the flow hole is formed in front of the retainer portion such that the refrigerant introduced through the inlet can flow to the outlet when the injection valve is opened on the retainer portion, the refrigerant flow through the gasket retainer is not interfered, and thus, no pressure loss occurs.

Also, according to the embodiment, the bead portion is provided not only on both the radial outer circumference and radial inner circumference of the fastening hole in the gasket retainer, but also on the point where the inclination of the retainer portion starts, so that the bending point of the injection valve can be accurately determined.

Also, a hole is formed in the valve portion of the injection valve according to the embodiment, so that it is possible to prevent distortion and reduce the power during the opening and closing operation of the injection valve.

The effect of the present disclosure is not limited to the above effects and should be construed as including all the effects that can be inferred from the configuration of the present disclosure disclosed in the detailed description or claims of the present disclosure.

DESCRIPTION OF AN EMBODIMENT

Figure 1:
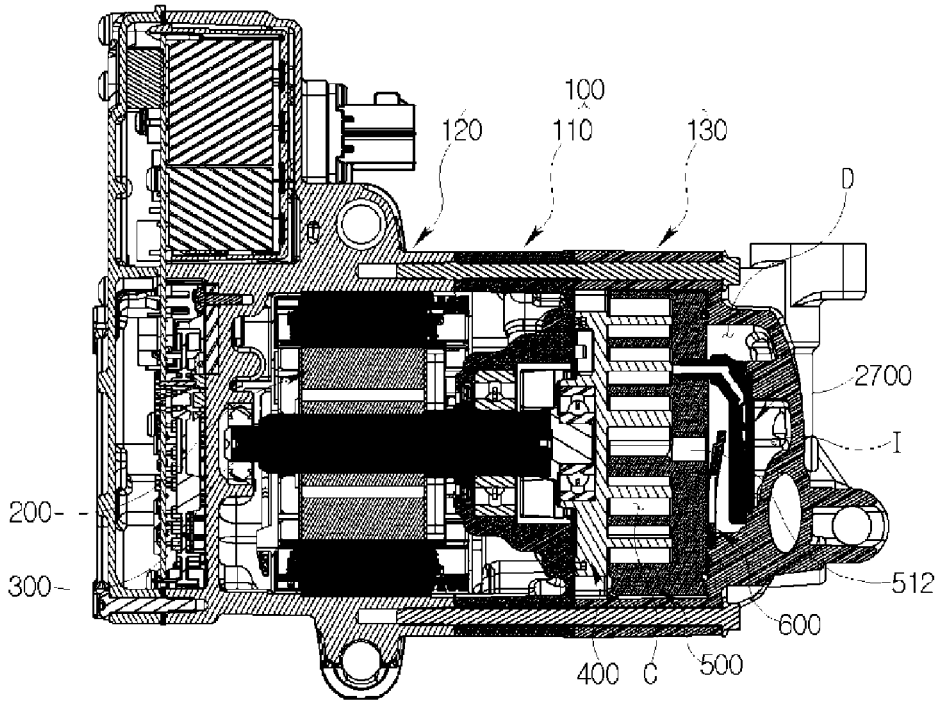
FIG. 1 is a cross-sectional view showing a scroll compressor according to an embodiment of the present disclosure.

Hereinafter, a preferred embodiment of a scroll compressor of the present disclosure will be described with reference to the accompanying drawings.

Also, the below-mentioned terms are defined in consideration of the functions in the present disclosure and may be changed according to the intention of users or operators or custom. The following embodiments do not limit the scope of the present disclosure and are merely exemplary of the components presented in the claims of the present disclosure.

Parts irrelevant to the description will be omitted for a clear description of the present disclosure. The same or similar reference numerals will be assigned to the same or similar components throughout this specification. Throughout this specification, when it is mentioned that a portion "includes" an element, it means that the portion does not exclude but further includes other elements unless there is a special opposite mention.

The scroll compressor according to the embodiment of the present disclosure includes a housing 100, a motor 200 provided within the housing 100, a rotation shaft 300 that is rotated by the motor 200, an orbiting scroll 400 that performs an orbiting motion in conjunction with the rotation shaft 300, a fixed scroll 500 that forms, together with the orbiting scroll 400, a compression chamber C, and a discharge valve 600 that is disposed on one surface of the fixed scroll 500 and configured to open or close a discharge port 512 of the fixed scroll from which a refrigerant compressed in the compression chamber C is discharged. Here, the components identical to the components of the scroll compressor of Patent Document 2 are denoted by the same reference numerals, and detailed descriptions of the identical components will be omitted.

Also, the scroll compressor according to the embodiment may further include an injection valve assembly 2700 that forms and opens or closes an injection flow path configured to guide an intermediate pressure refrigerant to the compression chamber C from the outside of the housing 100 (e.g., a downstream side of a condenser in a vapor compression refrigeration cycle including the scroll compressor, the condenser, an expansion valve, and an evaporator).

The housing 100 includes a center housing 110 through which the rotation shaft 300 passes, a front housing 120 that forms a motor receiving space receiving the motor 200, and a rear housing 130 that forms a discharge chamber D receiving the refrigerant discharged from the compression chamber C. The injection valve assembly 2700 may be interposed between the fixed scroll 500 and the rear housing 130. The injection valve assembly 2700 covers an introduction chamber I which is within the rear housing 130 and into which the refrigerant is introduced from the outside of the housing. The injection valve assembly 2700 guides the refrigerant of the introduction chamber I to the compression chamber C.

Figure 2:
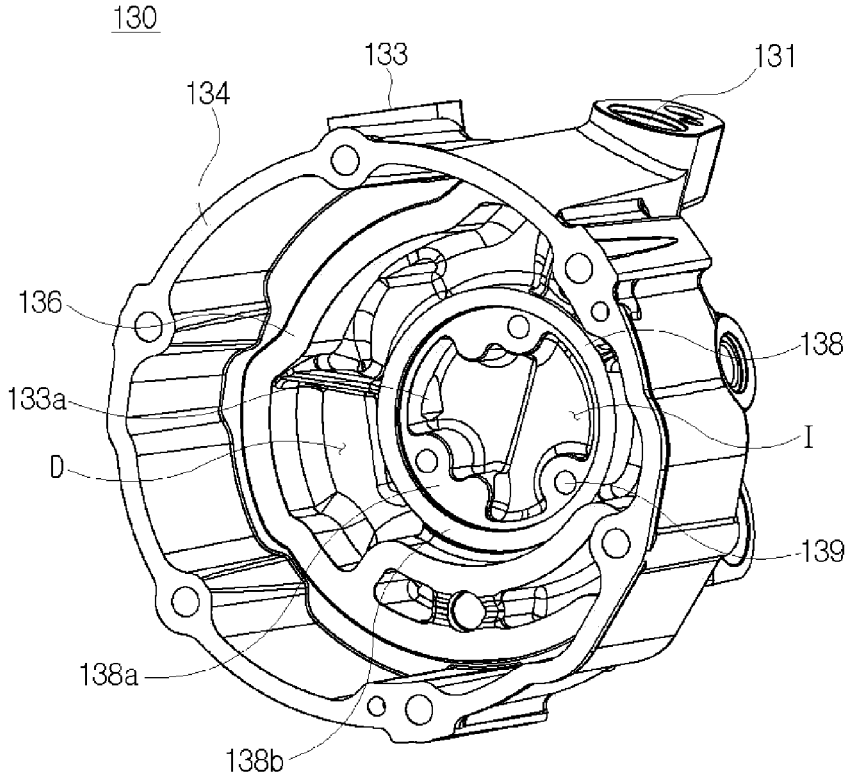
FIG. 2 is a perspective view showing a separated rear housing of FIG. 1.

As shown in FIG. 2, the rear housing 130 includes a first annular wall 134 that protrudes from a rear end plate and is located on the outermost side in the circumferential direction, a second annular wall 136 that protrudes from the rear end plate and is received in the first annular wall 134, and a partition wall 138 that protrudes from the rear end plate and is received in the second annular wall 136. Here, the first annular wall 134, the second annular wall 136, and the partition wall 138 are formed to have different heights.

The first annular wall 134 is fastened to the center housing 110 and forms a scroll receiving space, and the second annular wall 136 comes into contact with the fixed scroll 500 and form the discharge chamber D. Here, as the second annular wall 136 contacts the fixed scroll 500, when the rear housing 130 is fastened to the center housing 110, the fixed scroll 500 is pressed toward the center housing 110, thereby improving a fastening force between the fixed scroll 500 and the center housing 110 and preventing leakage. The partition wall 138 has a protruding length less than that of the second annular wall 136 in such a way as to be spaced apart from the fixed scroll 500. Also, as to be described below, the partition wall 138 is covered by a cover plate 2710 of the injection valve assembly 2700 and partitions the introduction chamber I.

Figure 5:
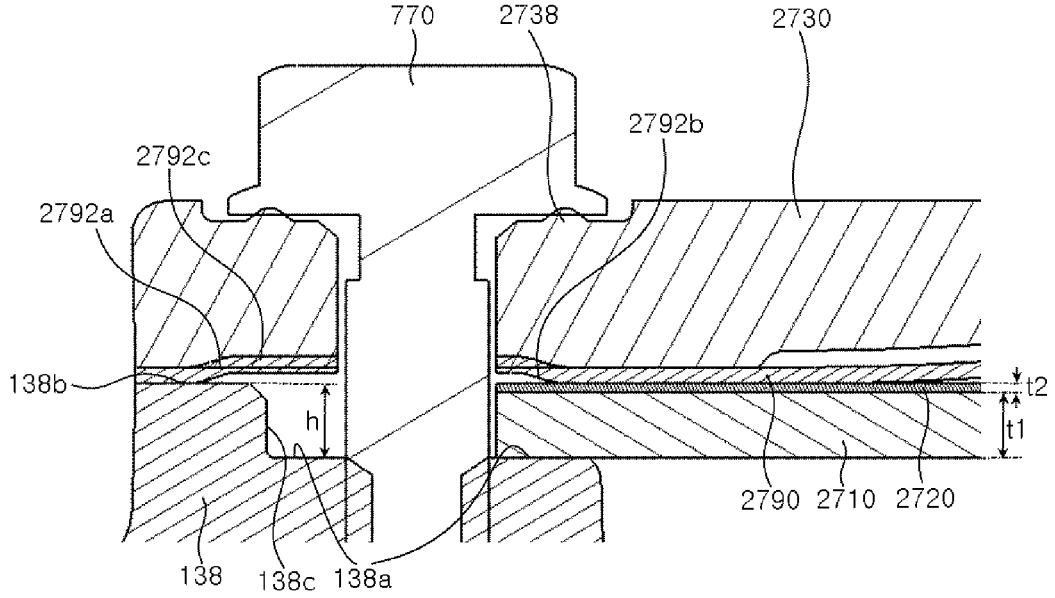
FIG. 5 is a partial cross-sectional view of FIG. 4.

Here, as shown in FIGS. 2 and 5, the partition wall 138 has a first surface 138*a* and a second surface 138*b* higher than the first surface 138*a* such that they surround a portion of a side of the injection valve assembly 2700. Specifically, the first surface 138*a* and the second surface 138*b* extend in parallel, and the second surface 138*b* protrudes more from the rear end plate than the first surface 138*a*, and thus, is higher than the first surface 138*a*. The first surface 138*a* is formed more inward in the partition wall in the radial direction than the second surface 138*b*, so that a stepped portion formed by the first surface 138*a* and the second surface 138*b* may be formed concavely around the inside of the partition wall. The first surface 138*a* and the second surface 138*b* are connected by a third surface 138*c* facing a portion of the side of the injection valve assembly 2700. The third surface 138*c* may extend vertically from the first surface 138*a* and be connected to the second surface 138*b*.

Figure 4:
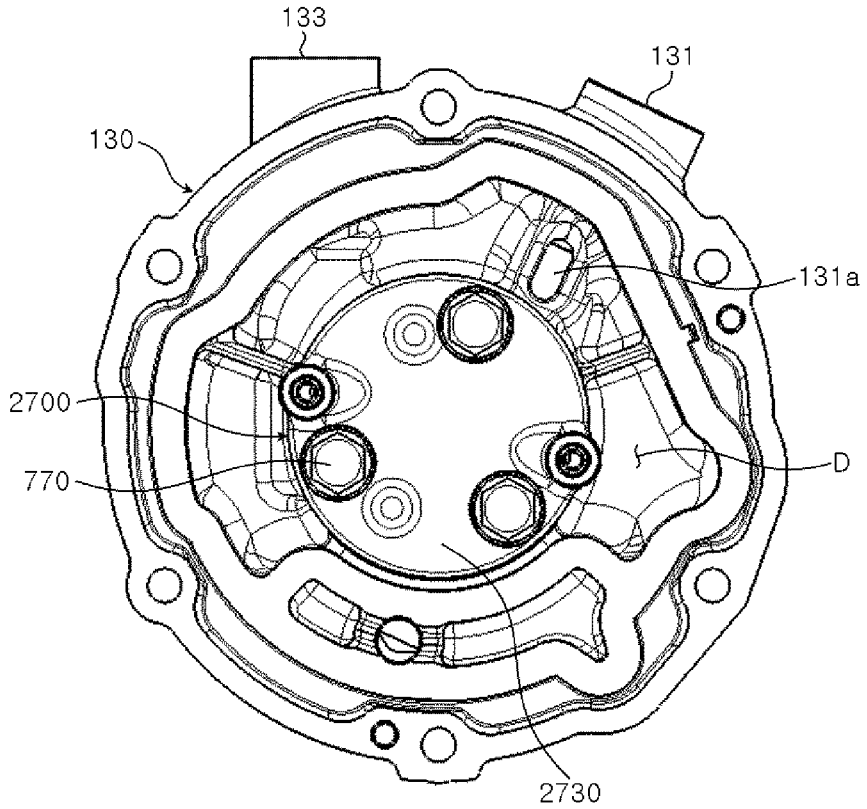
FIG. 4 is a front view showing a state in which the injection valve assembly of FIG. 3 has been assembled to the rear housing.

A discharge port 131 that guides the refrigerant in the discharge chamber D to the outside of the housing 100 is formed on the rear end plate of the rear housing 130. The refrigerant in the discharge chamber D is guided to the discharge port 131 through a discharge port inlet 131*a* shown in FIG. 4. Also, an introduction port 133 through which the intermediate pressure refrigerant is introduced from the outside of the housing 100 is formed on the rear end plate of the rear housing 130. The intermediate pressure refrigerant may be guided from the introduction port 133 to the introduction chamber I through an introduction port outlet 133*a* shown in FIG. 2.

Here, the positions of the discharge port 131 and the introduction port 133 may be changed depending on a vehicle. In order to freely change the design of the injection valve assembly 2700 according to the position of the port for each vehicle, the injection valve assembly 2700 according to the embodiment of the present disclosure may be formed in a circular shape. That is, as the injection valve assembly 2700 is formed in a circular shape, the injection valve assembly 2700 is able to rotate with respect to the introduction chamber I, so that it is possible to freely change the design of the injection valve assembly 2700 depending on the position of the port for each vehicle. In addition, an axial force of a fastening bolt 770 and surface pressure generated by a bead portion of a gasket retainer 2790, which will be described later, may be wholly uniformly transferred along the perimeter of the injection valve assembly 2700.

In addition, in the present disclosure, the fastening member for fastening the injection valve assembly 2700 to the rear housing 130 is disposed on the introduction chamber I side, not on the discharge chamber D side, and specifically on the first surface 138*a* of the partition wall. Hereinafter, the fastening member will be described as a fastening bolt 770. Accordingly, the injection valve assembly 2700 can be compactified and the design of the injection valve assembly can be changed more easily. For this purpose, as shown in FIG. 2, a first fastening recess 139 into which the fastening bolt 770 is inserted is formed on the first surface 138*a* of the partition wall of the rear housing 130.

Hereinafter, the injection valve assembly 2700 will be described in detail with reference to FIGS. 3 to 9. The injection valve assembly 2700 is provided on a front-end surface of the partition wall 138 in such a way as to communicate and block between an injection port of the fixed scroll 500 and the introduction chamber I.

Specifically, the injection valve assembly 2700 may include the cover plate 2710 that is disposed on the partition wall 138 and has an inlet 2712 through which the refrigerant of the introduction chamber I is introduced, a gasket retainer 2790 that is coupled to the partition wall 138, an injection valve 2720 that is interposed between the cover plate 2710 and the gasket retainer 2790 and opens or closes the inlet 2712, and a valve plate 2730 that is coupled to the gasket retainer 2790 and has an outlet 2736 through which the refrigerant introduced through the inlet 2712 flows out.

Figure 3:
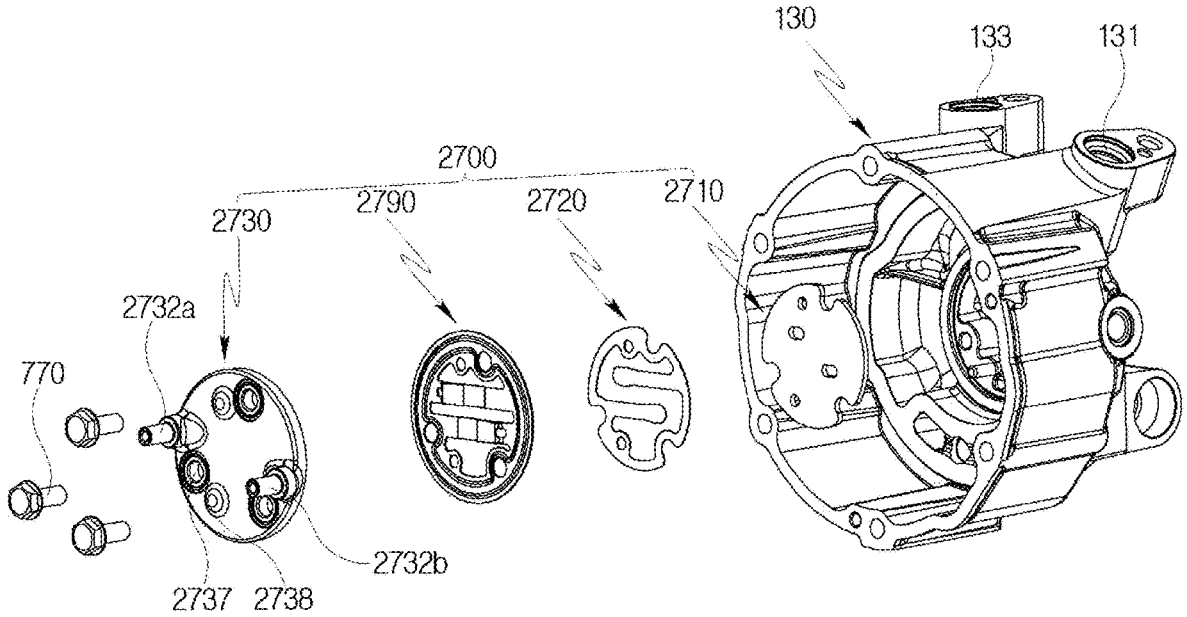
FIG. 3 is an exploded perspective view showing that the rear housing of FIG. 1 and an injection valve assembly of FIG. 1 that is received in the rear housing are disassembled.
Figure 6:
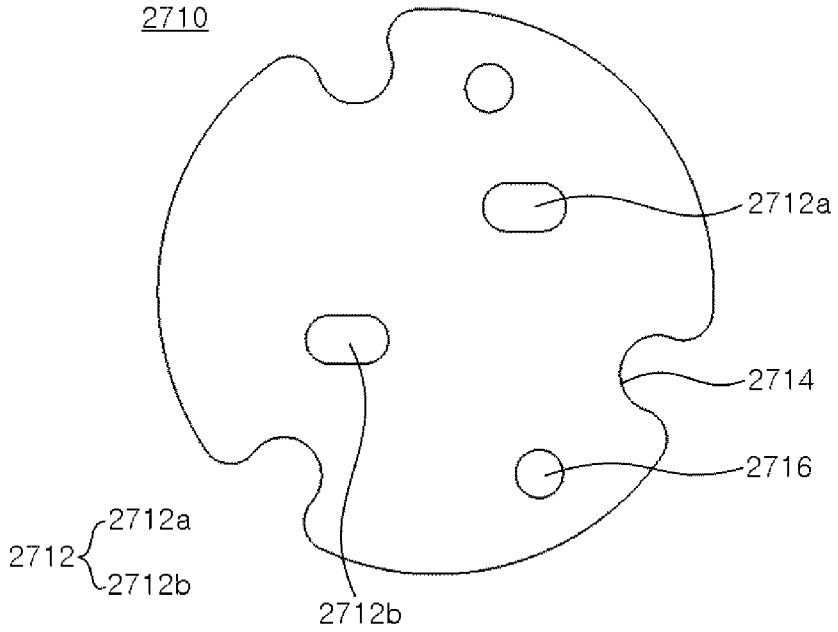
FIG. 6 is a rear view of a cover plate of FIG. 3.

As shown in FIGS. 3 and 6, the cover plate 2710 is formed as a circular plate and includes a pair of inlets 2712*a* and 2712*b* through which the refrigerant of the introduction chamber I is introduced. That is, the cover plate 2710 includes the first inlet 2712*a* that communicates with one side of the introduction chamber I and the second inlet 2712*b* that is formed independently of the first inlet 2712*a* and communicates with the other side of the introduction chamber I. Here, it is preferable that the first inlet 2712*a* and the second inlet 2712*b* should be formed in the form of an elongated hole respectively in order to maximize a valve lifting force and refrigerant inlet flow rate.

In particular, in the embodiment, the cover plate 2710 is seated on a concave portion composed of the first surface 138*a* and the third surface 138*c* so as to come in surface contact with the first surface 138*a* of the partition wall. Accordingly, the cover plate 2710 itself can perform serve as a seal to prevent internal leakage between the discharge chamber D and the introduction chamber I. As a result, there is no requirement for a separate O-ring between the partition wall 138 of the rear housing and the cover plate 2710 and groove processing for the O-ring, so that the number of parts, processing time, and cost can be reduced and there is no problem that the O-ring is separated from the groove.

Moreover, as will be described later, the injection valve assembly 2700 includes the gasket retainer 2790 coupled to the second surface 138*b* of the partition wall in such a manner as to surround the stepped portion, thereby preventing the internal leakage between the discharge chamber D and the introduction chamber I by the single sealing member (gasket retainer).

Here, it is desirable that the partition wall 138 should be formed in a circular shape as with the injection valve assembly 2700 formed in a circular shape. Due to this, the cover plate 2710 is seated on the concave portion of the stepped portion, thereby covering the introduction chamber I within the partition wall 138.

As shown in FIG. 5, in order for the cover plate 2710 to fixedly support the injection valve 2720 and also to satisfy the sealing, it is preferable that a height difference "h" between the first surface 138*a* and the second surface 138*b* should be smaller than a sum of a thickness "t1" of the cover plate 2710 and a thickness "t2" of the injection valve 2720. By satisfying these dimensions, the injection valve 2720 can be pressed and fixed between the cover plate 2710 and the gasket retainer 2790. That is, the injection valve 2720 can be unconditionally fixed in contact with the gasket retainer 2790, and appropriate surface pressure is formed between the injection valve 2720 and the gasket retainer 2790, so that it is possible to prevent damage to the injection valve 2720 by vibration that is generated when the refrigerant flows through the injection valve 2720.

The cover plate 2710 further includes a first positioning hole 2716 through which a positioning pin passes. Also, since the fastening bolt 770 is disposed within the partition wall 138, a second fastening recess 2714 that is formed concave inward in the radial direction for the fastening bolt 770 to pass through is formed on a periphery of the cover plate 2710.

Figure 7:
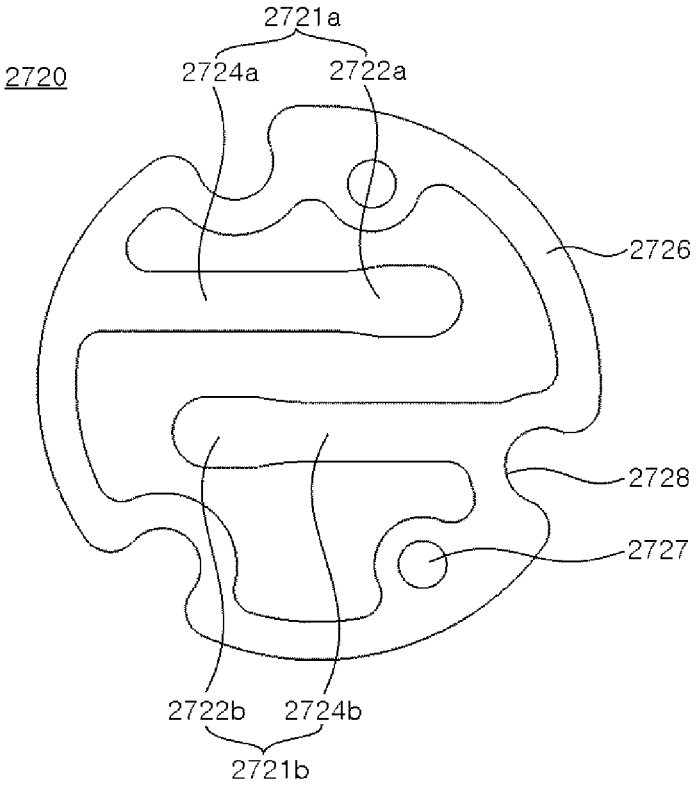
FIG. 7 is a rear view of an injection valve of FIG. 3.

As shown in FIGS. 3 and 7, the injection valve 2720 includes a circular body portion 2726 and a pair of valve portions 2721*a* and 2721*b* extending from the body portion 2726 toward the pair of inlets 2712*a* and 2712*b*, respectively. That is, the injection valve 2720 includes the first valve portion 2721*a* extending from one side of the body portion 2726 toward the first inlet 2712*a* in order to open or close the first inlet 2712*a*, and the second valve portion 2721*b* extending from the other side of the body portion 2726 toward the second inlet 2712*b* in order to open or close the second inlet 2712*b*. In the embodiment, the first valve portion 2721*a* and the second valve portion 2721*b* extend parallel to each other on the opposite side of the body portion 2726. It is preferable that the body portion 2726 and the pair of valve portions 2721*a* and 2721*b* should be formed integrally in order to reduce the number of parts, size, cost, and weight.

Here, the first valve portion 2721*a* includes a first head 2722*a* that is disposed on the first inlet 2712*a*, and a first leg 2724*a* that connects the first head 2722*a* and the body portion 2726. Likewise, the second valve portion 2721*b* includes a second head 2722*b* that is disposed on the second inlet 2712*b*, and a second leg 2724*b* that connects the second head 2722*b* and the body portion 2726.

The body portion 2726 further includes a second positioning hole 2727 which is in communication with the first positioning hole 2716 and through which a positioning pin passes. Also, a third fastening recess 2728 that is formed concave inward in the radial direction for the fastening bolt 770 to pass through is formed on a periphery of the injection valve 2720, more precisely, on a periphery of the body portion 2726.

Figure 8:
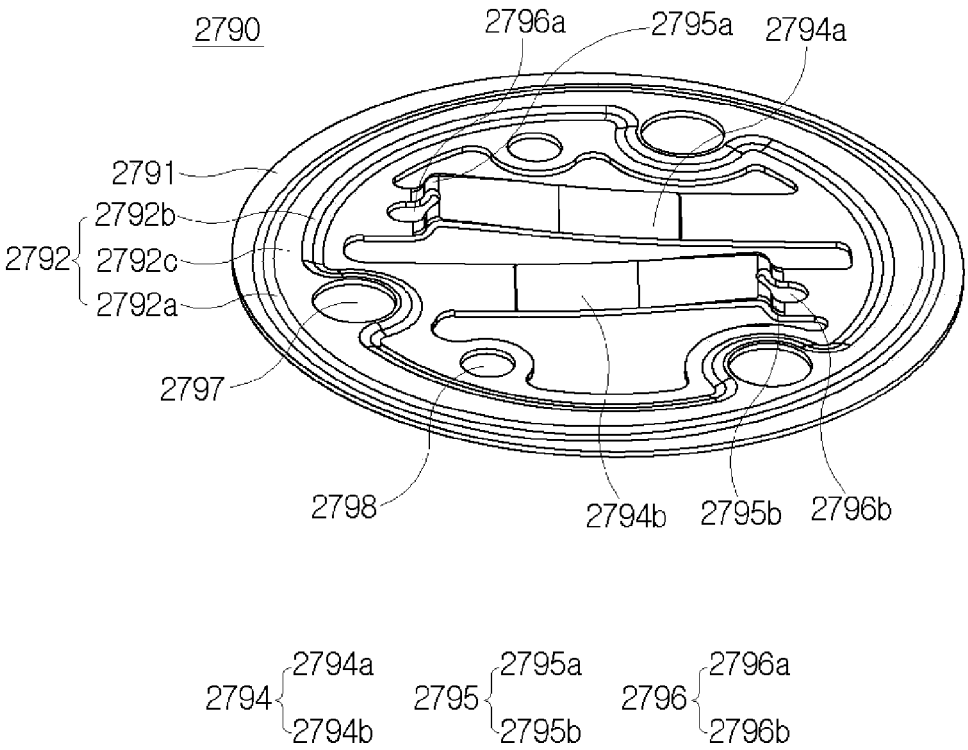
FIG. 8 is a perspective view of a gasket retainer of FIG. 3 when viewed from another side.

As shown in FIGS. 3 and 8, the gasket retainer 2790 includes a circular body portion 2791, a pair of retainer portions 2794*a* and 2794*b* obliquely extending close to the valve plate 2730 toward the pair of inlets 2712*a* and 2712*b* from the body portion 2791, and a pair of support portions 2795*a* and 2795*b* that connects the body portion 2791 and the pair of retainer portions 2794*a* and 2794*b*, respectively, in order to support the retainer portion and is formed to be inclined. It is preferable that the peripheral shape and dimension of the body portion 2791 of the gasket retainer should be the same as the outer peripheral shape and dimension of the partition wall 138.

Specifically, the gasket retainer 2790 includes the first retainer portion 2794*a* extending obliquely from one side of the body portion 2791 toward the first inlet 2712*a* in such a way as to correspond to the first valve portion 2721*a*, and a second retainer portion 2794*b* extending from the other side of the body portion 2791 toward the second inlet 2712*b* in such a way as to correspond to the second valve portion 2721*b*. Also, the first support portion 2795*a* connects the other side of the body portion 2791 and the first retainer portion 2794*a*, and the second support portion 2795*b* connects one side of the body portion 2791 and the second retainer portion 2794*b*.

The first retainer portion 2794*a* and the second retainer portion 2794*b* are processed obliquely to be closer to the valve plate 2730 as they extend from the body portion 2791. Therefore, when the injection valve 2720 is opened to open the pair of inlets 2712, the first retainer portion 2794*a* and the second retainer portion 2794*b* may limit positions where the first valve portion 2721*a* and the second valve portion 2721*b* are opened to the maximum while supporting the first valve portion 2721*a* and the second valve portion 2721*b*, respectively. In the embodiment, the first retainer portion 2794*a* and the second retainer portion 2794*b* extend parallel to each other on opposite side of the body portion 2791 in correspondence to the first valve portion 2721*a* and the second valve portion 2721*b*.

Here, a flow hole 2796 may be formed in front of the retainer portion 2794 such that the refrigerant introduced through the inlet 2712 can flow to the outlet 2736 to be described later, without pressure loss when the injection valve 2720 is opened on the retainer portion 2794. In the embodiment, since the support portion 2795 is connected to the front end of the retainer portion 2794 that is spaced furthest from the body portion 2791 in the direction in which the injection valve 2720 is opened, the flow hole 2796 may be formed in the support portion 2795. That is, the first support portion 2795*a* is provided with the first flow hole 2796*a*, so that the refrigerant introduced through the first inlet 2712*a* can flow directly through the first flow hole 2796*a* to the first outlet 2736*a* to be described later, and the second support portion 2795*b* is provided with the second flow hole 2796*b*, so that the refrigerant introduced through the second inlet 2712*b* can flow directly through the second flow hole 2796*b* to the second outlet 2736*b* to be described later. In particular, the retainer portion 2794 and the support portion 2795 are arranged in a line. Due to this, the refrigerant introduced through the inlet 2712 can flow directly to the outlet 2736 through the flow hole 2796 instead of flowing to both sides of the retainer portion 2794, so that the refrigerant flow through the gasket retainer 2790 is not interfered, and thus, no pressure loss occurs.

In addition, an open surface of the flow hole 2796 may extend from the support portion 2795 to a portion of the body portion 2791, and may include a surface parallel to the body portion 2791 and an inclined surface of the support portion 2795. The interference of the refrigerant flow can be further minimized.

The gasket retainer 2790 further includes a bead portion 2792 protruding toward the valve plate 2730 on the circumference thereof, more precisely, on the circumference of the body portion 2791. As shown in FIG. 5, when the injection valve assembly 2700 is assembled, the bead portion 2792 is disposed on the radially outer side of the injection valve 2720. As such, the gasket retainer 2790 is coupled to the second surface 138*b* of the partition wall and surrounds the stepped portion, and the bead portion 2792 is formed on the circumference, so that the bead portion 2792 is pressed between the partition wall 138 and the valve plate 2730 by the fastening force of the fastening bolt 770 and sealing is made between the partition wall 138 and the valve plate 2730.

Specifically, the bead portion 2792 includes an outer inclined bead portion 2792*a* on the radially outer side thereof, an inner inclined bead portion 2792*b* on the radially inner side thereof, and a protruding bead portion 2792*c* connecting the outer inclined bead portion 2792*a* and the inner inclined bead portion 2792*b*. In the embodiment, the outer inclined bead portion 2792*a* and the inner inclined bead portion 2792*b* extend to the same height, so that the protruding bead portion 2792*c* is formed in a flat shape. As a result, the outer inclined bead portion 2792*a* may be compressed between the second surface 138*b* of the partition wall and the valve plate 2730 during the assembly, and the inner inclined bead portion 2792*b* may be compressed between the first surface 138*a* of the partition wall and the valve plate 2730 during the assembly.

The gasket retainer 2790 further includes a fourth fastening hole 2797 through which the fastening bolt 770 passes, and a third positioning hole 2798 that communicates with the second positioning hole 2727 and through which the positioning pin passes. Here, the bead portion 2792 surrounds the fourth fastening hole 2797 in order to support and evenly transmit the fastening force generated by the fastening bolt 770. Specifically, the fourth fastening hole 2797 is formed more inward in the radial direction than the outer inclined bead portion 2792*a* and is formed at a position overlapping the inner inclined bead portion 2792*b*. However, when the inner inclined bead portion 2792*b* passes through the fourth fastening hole 2797, the inner inclined bead portion 2792*b* detours radially inward and is arranged to surround the fourth fastening hole 2797.

Figure 9:
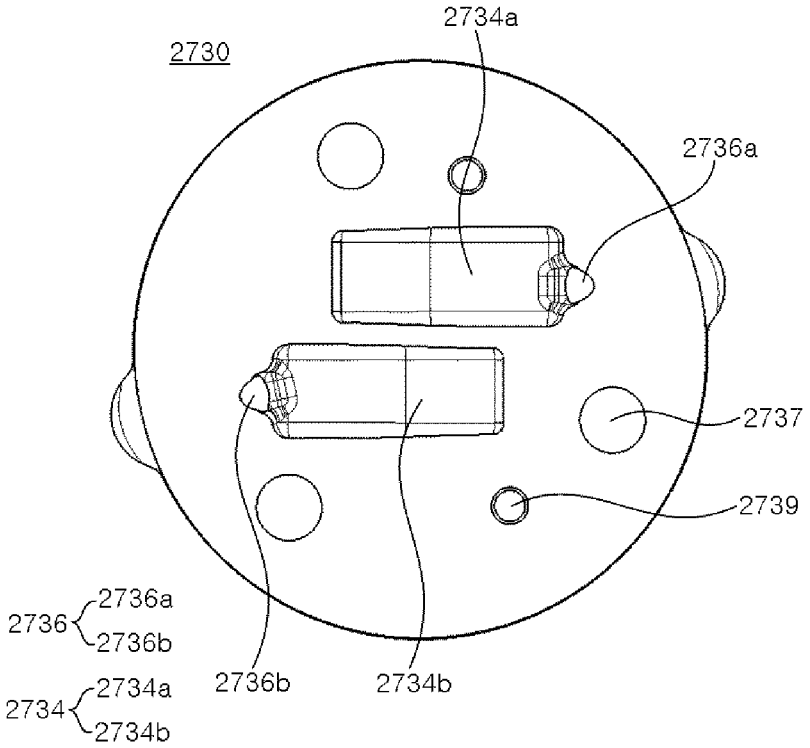
FIG. 9 is a rear view of a valve plate of FIG. 3.

Next, as shown in FIGS. 3 and 9, the valve plate 2730 is formed as a circular plate, and includes a pair of inclined spaces 2734*a* and 2734*b* on which the pair of retainer portions 2794*a* and 2794*b* is seated and which receives the refrigerant introduced through the pair of inlets 2712*a* and 2712*b*, and the pair of outlets 2736*a* and 2736*b* that communicates with the pair of inclined spaces and through which the refrigerant flows out. That is, the first retainer portion 2794*a* is seated on the first inclined space 2734*a*, and the refrigerant introduced through the first inlet 2712*a* is received in the first inclined space 2734*a* and flows out through the first outlet 2736*a*. Also, the second retainer portion 2794*b* is seated on the second inclined space 2734*b*, and the refrigerant introduced through the second inlet 2712*b* is received in the second inclined space 2734*b* and flows out through the second outlet 2736*b*. The first inclined space 2734*a* and the second inclined space 2734*b* are concavely formed to have an inclination corresponding to the first retainer portion 2794*a* and the second retainer portion 2794*b*, and are formed parallel to each other.

The valve plate 2730 further includes a first protrusion 2732*a* and a second protrusion 2732*b* which protrude toward the injection port of the fixed scroll 500. The first outlet 2736*a* passes through the first protrusion 2732*a* from the first inclined space 2734*a*, and the second outlet 2736*b* passes through the second protrusion 2732*b* from the second inclined space 2734*b*. As a result, the refrigerant flowing out of the outlet 2736 may be supplied to the compression chamber C through the injection port of the fixed scroll 500.

Here, such that the refrigerant flowing through the flow hole 2796 can flow out directly to the outlet 2736 without pressure loss, it is preferable that the first outlet 2736*a* should be disposed at a position corresponding to the first flow hole 2796*a* and the second outlet 2736*b* should be disposed at a position corresponding to the second flow hole 2796*b*.

The valve plate 2730 further includes a fifth fastening hole 2737 through which the fastening bolt 770 passes, and a fourth positioning recess 2739 that communicates with the third positioning hole 2798 and into which the positioning pin is inserted. The fifth fastening hole 2737 of the valve plate is disposed on the radially outer side of the inclined space 2734.

Accordingly, the positioning pin passes through the first positioning hole 2716, the second positioning hole 2727, and the third positioning hole 2798 and is inserted into the fourth positioning recess 2739, so that the cover plate 2710, the injection valve 2720, the gasket retainer 2790, and the valve plate 2730 can be aligned.

Also, the fastening bolt 770 passes through the fifth fastening hole 2737 and the fourth fastening hole 2797 and is fastened to the first fastening recess 139 through the third fastening recess 2728 and the second fastening recess 2714, so that the injection valve assembly 2700 may be fastened to the rear housing 130.

Here, since the fastening bolt 770 is disposed on the introduction chamber I side, specifically on the first surface 138*a* of the partition wall, there is a concern that the refrigerant leaks through the space through which the fastening bolt 770 passes. For the purpose of preventing this, the injection valve assembly may be provided with a sealing portion which seals between the injection valve assembly 2700 and a head of the fastening bolt 770.

In the embodiment, as shown in FIGS. 3 and 5, the sealing portion 2738 is provided on one surface of the valve plate 2730 where the head of the fastening bolt 770 is seated, and the sealing portion 2738 protrudes to surround the fifth fastening hole 2737 of the valve plate. Accordingly, the fastening bolt 770 may be strongly engaged with the sealing portion 2738 as being fastened, and sealing may be made between the head of the fastening bolt 770 and one surface of the valve plate 2730. Therefore, it is possible to prevent refrigerant leakage.

However, the embodiment is not limited to this, and it is possible that the sealing portion may be formed of a separate O-ring, etc., and may be inserted between the head of the fastening bolt 770 and one side of the valve plate 2730 and compressed when the fastening bolt is tightened.

Next, a gasket retainer 3790 according to another embodiment of the present disclosure will be described with reference to FIGS. 10 and 11.

As described above, the gasket retainer 3790 includes a fourth fastening hole 3797 through which the fastening bolt 770 passes, and a pair of retainer portions 3794*a* and 3794*b* that is inclined in a direction in which the injection valve opens, that is, toward the valve plate.

However, in the embodiment, the pair of retainer portions 3794*a* and 3794*b* is processed on the gasket retainer 3790 in such a manner as to be inclined by a cutting portion. Specifically, an inner portion of a body portion 3791 of the gasket retainer 3790 cut by the U-shaped cutting portion is processed as the retainer portion 3794. Here, a pair of wing portions 3795 connecting both sides of the retainer portion 3794 and the body portion 3791 facing them is provided on both sides of each of the retainer portions 3794 in order to maintain the inclination angle of the retainer portion. Accordingly, a U-shaped main flow hole 3796*c* may be formed on one side of the pair of wing portions 3795, and a pair of straight auxiliary flow holes 3796*d* may be formed on the other side. As a result, when the injection valve is opened, the refrigerant flowing into the inlet of the cover plate can flow into the inclined space of the valve plate through the main flow hole 3796*c* and the pair of auxiliary flow holes 3796*d*.

Here, the gasket retainer 3790 may include a first bead portion 3792*d*, a second bead portion 3792*e*, and a valve bead portion 3792*f*. The first bead portion 3792*d* extends along a radial outer circumference of the fourth fastening hole 3797 and protrudes toward the cover plate. The second bead portion 3792*e* extends along a radial inner circumference of the fourth fastening hole 3797 and protrudes toward the cover plate. The valve bead portion 3792*f* is provided in each of the retainer portions 3794 and protrudes toward the valve plate. That is, while the first bead portion 3792*d* and the second bead portion 3792*e* protrude in the same direction, the valve bead portion 3792*f* protrudes in the opposite direction to the first bead portion 3792*d* and the second bead portion 3792*e*.

Here, the height and width, etc., of the bead portion may be set differently according to the importance of leakage. The first bead portion 3792*d* is the most important bead for preventing leakage by a high discharge pressure from the discharge chamber D. Also, the second bead portion 3792*e* is used to prevent the refrigerant from flowing backward when a pressure in the compression chamber C becomes higher than a pressure in the introduction chamber I as the scroll rotates. Accordingly, the protrusion height of the first bead portion 3792*d* can be formed to be greater than the protrusion height of the second bead portion 3792*e* (see FIG. 13). Moreover, the width of the first bead portion 3792*d* can also be formed to be greater than the width of the second bead portion 3792*e*. Accordingly, the axial force of the fastening bolt 770 can be further applied to the first bead portion 3792*d*, thereby enabling reliable sealing.

Unlike the first bead portion 3792*d* and the second bead portion 3792*e*, the valve bead portion 3792*f* is not designed for sealing but for accurately determining (supporting) a bending point of the injection valve. For this purpose, it is desirable that the valve bead portion 3792*f* should be provided in the retainer portion 3794 at a point where the inclination of the retainer portion 3794 starts. Accordingly, the valve bead portion 3792*f* can press a point where the bending of the valve portion of the injection valve starts, that is, a portion that can be a reference point during the bending. In the embodiment, the valve bead portion 3792*f* is provided between the pair of auxiliary flow holes 3796*d* in a direction crossing the width of the retainer portion 3794.

In particular, unlike the first bead portion 3792*d* and the second bead portion 3792*e*, the valve bead portion 3792*f* protrudes toward the valve plate. Therefore, when the valve portion of the injection valve is completely opened, the entire area of the valve portion can come into uniform contact with the retainer portion 3794 of the gasket retainer, so that the valve portion can be stably supported (see FIG. 13). If the valve bead portion 3792*f* protrudes toward the cover plate in the same way as the first bead portion 3792*d* and the second bead portion 3792*e*, the valve bead portion can press the point where the bending of the valve portion starts. However, when the valve portion is opened, the valve portion unstably contact with the surface of the retainer portion 3794, and thus, there may be a risk that the valve portion is damaged.

Here, the protrusion height of the valve bead portion 3792*f* may be the same as the protrusion height of the second bead portion 3792*e*. In this case, the protrusion height of the first bead portion 3792*d* may be greater than the protrusion height of the second bead portion 3792*e* and the protrusion height of the valve bead portion 3792*f* (see FIG. 13).

Next, an injection valve 3720 according to another embodiment of the present disclosure will be described with reference to FIG. 12.

As described above, the injection valve 3720 includes a pair of valve portions 3721*a* and 3721*b* that is bent to open and close the inlet. However, in the embodiment, the pair of valve portions 3721*a* and 3721*b* corresponds to an inner portion cut by the cutting portion in a body portion 3726 of the injection valve 3720, and can be bent with respect to the body portion 3726.

When the injection valve assembly is compactified, the length of the valve portion 3721 of the injection valve is also reduced. When the length of the valve portion is reduced, the power required to open the valve portion increases. Also, when the width of the valve portion 3721 is reduced in order to reduce power consumption, there is a risk that the action of the valve portion is unstable and distortion occurs when the valve portion is opened and closed.

For the purpose of solving this problem, in the embodiment, each of the pair of valve portions 3721*a* and 3721*b* is provided with a hole 3729 extending in the longitudinal direction. In the embodiment, the hole 3729 is provided in the middle of the valve portion 3721 in the width direction and extends from the point where the bending of the valve portion 3721 starts to approximately the middle in the longitudinal direction. That is, the overall width of the valve portion 3721 is maintained wide, and the hole 3729 divides the width of the valve portion 3721 into two branches, making the width of a portion connected to the body portion 3726 smaller, thereby reducing the power required to lift the valve portion 3721.

Accordingly, even within a compact package, it is possible to prevent distortion and reduce the power during the opening and closing operation of the injection valve 3720.

Figure 10:
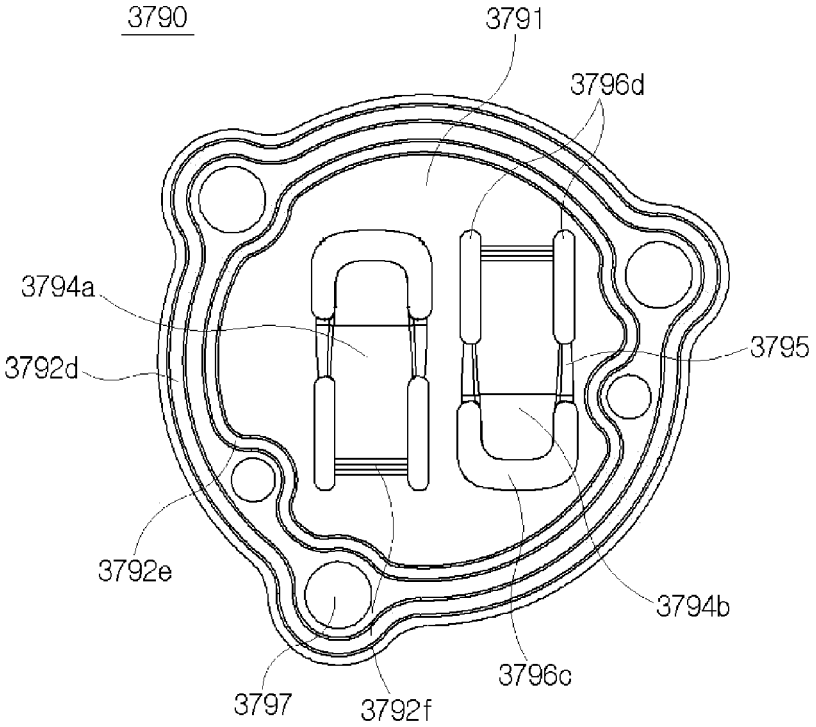
FIG. 10 is a front view showing a gasket retainer according to another embodiment of the present disclosure.
Figure 11:
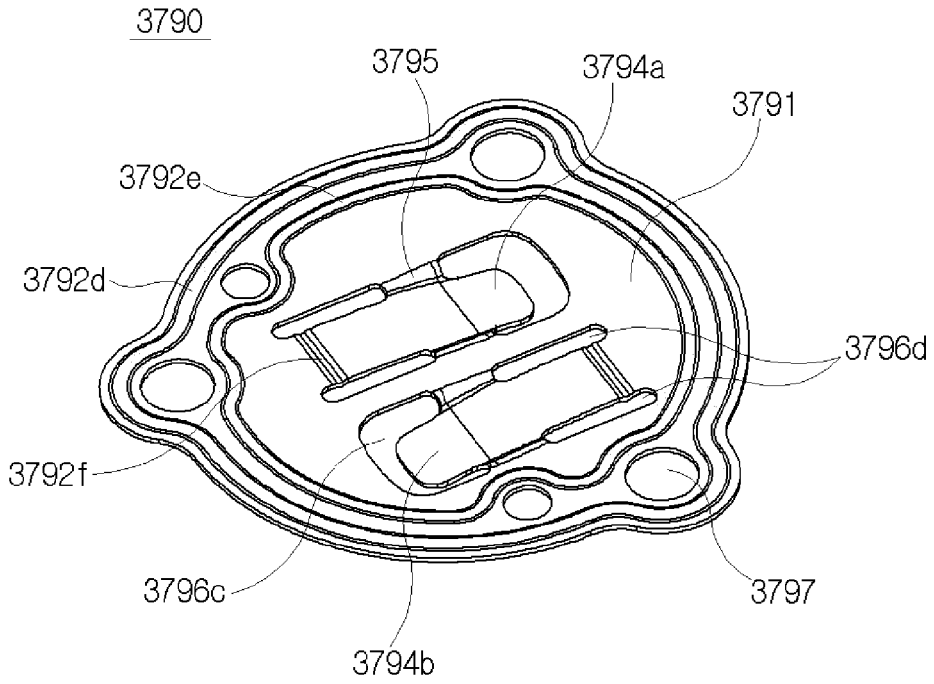
FIG. 11 is a perspective view of FIG. 10.
Figure 12:
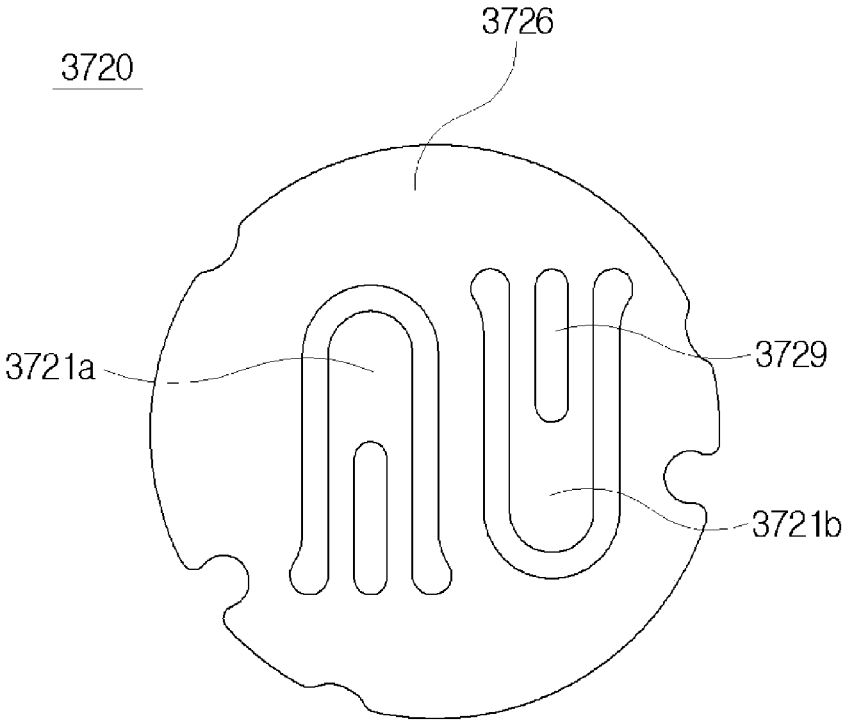
FIG. 12 is a front view showing an injection valve according to another embodiment of the present disclosure.
Figure 13:
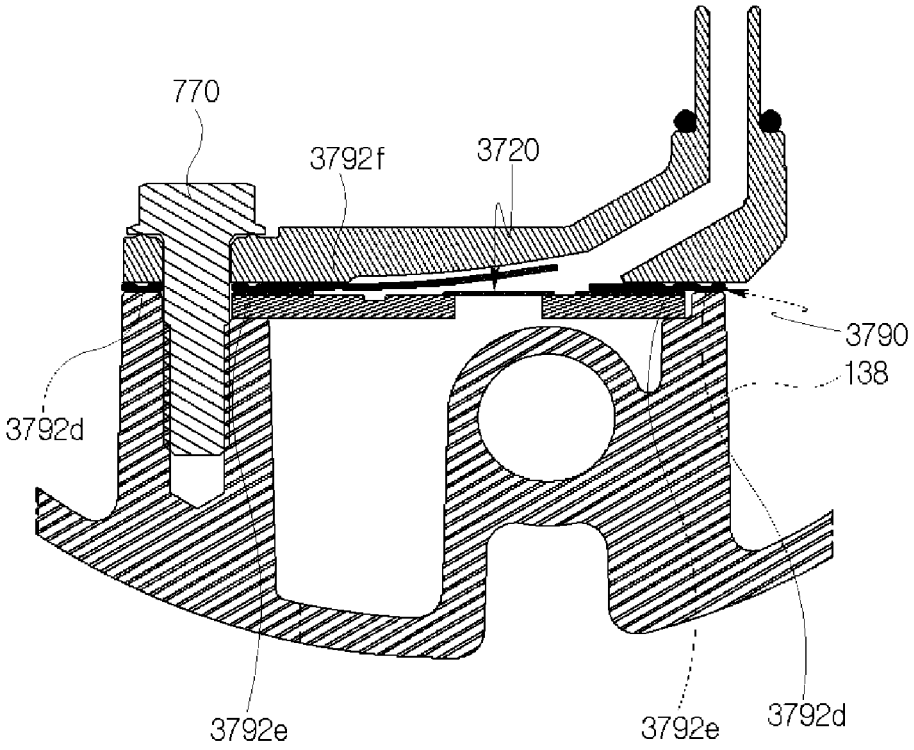
FIG. 13 is a cross-sectional view showing the injection valve assembly including the gasket retainer of FIG. 10 and the injection valve of FIG. 12 has been assembled to the rear housing.

FIG. 13 is a cross-sectional view showing the injection valve assembly including the gasket retainer 3790 of FIG. 10 and the injection valve 3720 of FIG. 12 is assembled to the rear housing 130. The structure described above may be applied to the valve plate and the cover plate of the injection valve assembly in the same manner.

Referring to FIG. 13, it can be seen that the valve bead portion 3792*f* protrudes in the opposite direction to the first bead portion 3792*d* and the second bead portion 3792*e*. Also, it can be seen that the height and width of the first bead portion 3792*d* are formed to be greater than those of the second bead portion 3792*e* and the valve bead portion 3792*f*.

The present invention is not limited to the described specific embodiments and descriptions described above. Various modifications can be made by anyone skilled in the art without departing from the subject matter of the present invention as defined by the appended claims. Such modifications fall within the scope of protection of the present invention.

INDUSTRIAL APPLICABILITY

The present disclosure relates to a scroll compressor and more particularly to a scroll compressor capable of improving the performance and efficiency of the compressor by increasing the amount of refrigerant discharged from a compression chamber by introducing not only refrigerant at suction pressure but also refrigerant at an intermediate pressure to the compression chamber of the scroll compressor, capable of freely changing the position of a port by simplifying the shape of an injection valve assembly and by disposing a fastening member on an introduction chamber side, and capable of compactifying the injection valve assembly.

The invention claimed is:

1. A scroll compressor comprising:

a housing;

a motor provided within the housing;

a rotation shaft configured to be rotated by the motor;

an orbiting scroll configured to perform an orbiting motion in conjunction with the rotation shaft; and a fixed scroll configured to form, together with the orbiting scroll, a compression chamber, wherein the housing further comprises a rear housing that forms a discharge chamber receiving a refrigerant discharged from the compression chamber, wherein the rear housing further comprises a partition wall that partitions the discharge chamber and an introduction chamber into which the refrigerant is introduced from the outside of the housing, wherein an injection valve assembly is provided between the fixed scroll and the partition wall of the rear housing, covers the introduction chamber, and guides the refrigerant of the introduction chamber to the compression chamber, wherein the partition wall has a first surface and a second surface higher than the first surface such that the partition wall surrounds a portion of a side of the injection valve assembly, and wherein a fastening member which fastens the injection valve assembly to a rear housing is disposed radially inner side of the second surface, wherein the injection valve assembly further comprises:

a cover plate configured to be disposed on the partition wall and has an inlet through which the refrigerant of the introduction chamber is introduced;

a gasket retainer configured to be coupled to the partition wall;

an injection valve configured to be interposed between the cover plate and the gasket retainer and opens or closes the inlet; and a valve plate configured to be coupled to the gasket retainer and to have an outlet through which the refrigerant introduced through the inlet flows out.

2. The scroll compressor of claim 1, wherein the injection valve assembly further comprises a sealing portion for sealing between the injection valve assembly and a head of the fastening member.

3. The scroll compressor of claim 1, wherein a sealing portion for sealing between the injection valve assembly and a head of the fastening member is provided on one surface of the valve plate where the head of the fastening member is seated, and wherein the sealing portion protrudes to surround a fastening hole of the valve plate, through which the fastening member passes.

4. The scroll compressor of claim 1, wherein a sealing portion for sealing between the injection valve assembly and a head of the fastening member is inserted between the head of the fastening member and one surface of the valve plate and is compressed when the fastening member is tightened.

5. The scroll compressor of claim 1, wherein the gasket retainer further comprises:

a bead portion extending along a circumference thereof and protruding toward the valve plate; and a fastening hole through which the fastening member passes, and wherein the bead portion surrounds the fastening hole.

6. The scroll compressor of claim 5, wherein the bead portion further comprises an outer inclined bead portion on a radially outer side thereof, an inner inclined bead portion on a radially inner side thereof, and a protruding bead portion connecting the outer inclined bead portion and the inner inclined bead portion, and wherein the fastening hole is formed more inward in a radial direction than the outer inclined bead portion.

7. The scroll compressor of claim 6, wherein the outer inclined bead portion is compressed between the second surface and the valve plate when the injection valve assembly is assembled, and the inner inclined bead portion is compressed between the first surface and the valve plate when the injection valve assembly is assembled.

8. The scroll compressor of claim 1, wherein the gasket retainer further comprises:

a fastening hole through which the fastening member passes;

a first bead portion which extends along a radial outer circumference of the fastening hole and protrudes toward the cover plate; and a second bead portion which extends along a radial inner circumference of the fastening hole and protrudes toward the cover plate.

9. The scroll compressor of claim 8, wherein the gasket retainer further comprises:

a retainer portion which is processed to be inclined in a direction in which the injection valve opens; and a valve bead portion which protrudes toward the valve plate.

10. The scroll compressor of claim 9, wherein the valve bead portion is provided at a point where an inclination of the retainer portion starts.

11. The scroll compressor of claim 9, wherein a protrusion height of the first bead portion is greater than a protrusion height of the second bead portion and a protrusion height of the valve bead portion.

12. The scroll compressor of claim 9, wherein the valve bead portion is provided in a direction crossing a width of the retainer portion.

13. The scroll compressor of claim 1, wherein the injection valve further comprises a valve portion which is bent to open and close the inlet, and wherein a hole extending in a longitudinal direction of the valve portion is provided in the valve portion.

14. The scroll compressor of claim 13, wherein the hole is provided in a middle of the valve portion in a width direction of the valve portion and extends in the longitudinal direction from a point where a bending of the valve portion starts.

15. The scroll compressor of claim 1, wherein the gasket retainer further comprises:

a circular body portion;

a retainer portion which obliquely extends close to the valve plate toward the inlet from one side of the body portion; and a support portion which connects the retainer portion and another side of the body portion in order to support the retainer portion and is formed to be inclined.

16. The scroll compressor of claim 15, wherein the support portion is connected to an end of the retainer portion that is spaced furthest from the body portion in a direction in which the injection valve is opened, and wherein a flow hole is formed in the support portion.

17. The scroll compressor of claim 16, wherein an open surface of the flow hole extends from the support portion to a portion of the body portion, and includes a surface parallel to the body portion and an inclined surface of the support portion.

18. The scroll compressor of claim 16, wherein the valve plate further comprises an inclined space where the retainer portion is seated, and wherein the outlet communicates with the inclined space and is disposed at a position corresponding to the flow hole.

19. The scroll compressor of claim 18, wherein a fastening hole of the valve plate, through which the fastening member passes, is disposed on a radially outer side of the inclined space.

* * * * *